US005257721A

United States Patent [19]

Smith et al.

[11] Patent Number: 5,257,721

[45] Date of Patent: Nov. 2, 1993

[54] PAINTER'S BOX

[76] Inventors: Dulany S. Smith; Alice G. Smith, both of 3157 Harvest Moon Dr., Palm Harbor, Fla. 34683

[21] Appl. No.: 971,388

[22] Filed: Nov. 4, 1992

[51] Int. Cl.[5] ..... B05L 17/00

[52] U.S. Cl. ..... 220/533; 220/335; 220/343; 206/1.7; 206/1.8; 206/575

[58] Field of Search ..... 220/533, 532, 335, 343; 206/1.7, 1.8, 575

[56] References Cited

U.S. PATENT DOCUMENTS

| | | | |
|---|---|---|---|
| 80,978 | 8/1868 | Lewis et al. | 220/335 |
| 413,544 | 10/1889 | Peace et al. | 220/335 X |
| 1,086,735 | 2/1914 | Spaulding | 206/1.7 |
| 2,593,138 | 4/1952 | Gombarts | 206/1.7 |
| 2,867,928 | 1/1959 | Angell | 206/1.8 |
| 3,506,324 | 4/1970 | Fristedt | 206/1.7 |
| 3,650,589 | 3/1972 | Linger | 206/1.7 X |
| 4,852,725 | 8/1989 | Folsom | 206/1.7 |

FOREIGN PATENT DOCUMENTS

| | | | |
|---|---|---|---|
| 125520 | 7/1949 | Sweden | 206/1.7 |

*Primary Examiner*—Allan N. Shoap
*Assistant Examiner*—Paul A. Schwarz
*Attorney, Agent, or Firm*—Joseph C. Mason, Jr.; Ronald E. Smith

[57] ABSTRACT

A painter's box or artist's sketch box has a removable lid, a reversible palette, movable partitions enabling the changing of the compartments of the box, a detachably mounted brush holder, a detachably mounted charcoal holder, and support legs that support the box when its lid is closed and which relieve stress on the hinges that interconnect the main body of the box and the lid when the lid is fully open. The hinges are of the pull-apart slip hinge type and include pins of differing lengths to facilitate reattachment of the lid to the main body of the box, and a groove is centered along the parting line of the lid and the main body to accommodate the hinge barrels to further facilitate alignment of the lid and the main body of the box. A thumb hole formed in the palette enables it to be held easily when separated from the box and provides an access opening for a jar of mineral spirits when the palette is not held. The peripheral edges of the palette are held within palette-accommodating recesses, formed in upstanding walls of the box, by the box lid when the lid is closed so that the palette can not move or make a rattling sound when the box is being transported.

15 Claims, 4 Drawing Sheets

PAINTER'S BOX

BACKGROUND OF THE INVENTION

1. Field of the Invention

This invention relates, generally, to an artist's sketch box having utility in storing and conveying various articles used by fine artists. More particularly, it relates to a box having multiple features so that the multiple articles used by a painter are efficiently stored and conveyed for facile retrieval and use.

2. Description of the Prior Art

Professional artists and hobbyists have access to several "painter's boxes" or "artist's sketch boxes" that have been developed over the years to facilitate storage and conveying of the various tools used by fine artists. The commercially successful boxes have utility, but none of them fully satisfies the needs of fine artists.

For example, most painter's boxes are merely compartmentalized containers for paint tubes. Typically, the compartments are inadequate in number and are permanently fixed into position. Some include a palette, but no means are provided to prevent said palette from rattling around within the box when it is stored therein. Nor do the known painter's boxes provide adequate means for efficiently storing brush boxes, charcoal holders, bottles for mineral spirits, and the like. Just as importantly, those boxes that provide compartments for such items provide no means for holding such items after they have been removed from their respective compartments. Still another drawback of the known devices is that they do not have removable lids. Moreover, the known compartmentalized boxes have a predetermined, inflexible floor plan which cannot be changed by the user. This impedes the artistic growth of the artist because the box cannot accommodate new instruments as the artist's needs are expanded or as the artist develops his or her craft.

Thus, there is a need for a painter's box that is not subject to the limitations of the presently known devices, but at the time the present invention was made, it was not obvious to those of ordinary skill in this art how the needed breakthrough could be achieved, in view of the prior art when considered as a whole.

SUMMARY OF THE INVENTION

The longstanding but heretofore unfulfilled need for a highly versatile painter's box that overcomes the limitations of earlier painter's boxes is now fulfilled.

The novel painter's box has a generally parallelepiped construction in a preferred embodiment thereof, but a container of any predetermined geometrical configuration is within the scope of this invention.

The box includes a lid and a main body that are hingedly connected together in a unique way that supports the lid when it is open. Moreover, the lid is detachable from the main body of the box, and unique means are provided that facilitate reattachment of the lid part of the hinges to the main box part of the hinges.

The hollow interior of the main body of the box is compartmentalized, but most of the partitions are movable so that the artist may arrange the floor plan of the box as desired to accommodate a wide variety of tools and accessories.

The uppermost inner edges of the side walls of the main body are recessed to receive the lateral edges of a palette and the depth of the recesses is substantially equal to the thickness of the palette so that when the palette is properly positioned, its top surface is flush with the uppermost outer edges of said side walls so that it does not interfere with the closing of the lid. The side walls of the lid are not recessed. Thus, when the lid is closed, the side walls of the lid overlie the edges of the palette and prevent it from moving or rattling around as long as the lid is closed.

A thumb hole opening is formed in the palette; it may be used to facilitate holding of the palette in the well-known way, or it may function as a well hole positioned over a jar of mineral spirits or the like when the palette is positioned atop the main body of the box. A pair of partitions flank the jar and hold it against movement when the box is in use or being transported.

A brush box is removably mountable to the slotted rear wall or side walls of the main body of the box, when the box is in use, and is conveniently stored within a dedicated brush box compartment when the box and its contents are in storage or in transport. Similarly, a charcoal holder is removeably mountable to either side wall of the main body, preferably, within the cut-out area of the palette, when the box is in use, and is snugly storable within the box within any preselected compartment when not in use.

The novel box includes additional features as well; it is versatile, easy to use, and comprehensive in design. It overcomes the inadequacies of earlier painter's boxes in an elegant way, and represents the world's first painter's box that fulfills all of the needs and wants of professional and amateur artists.

A primary object of this invention is to advance the art of painter's boxes in a significant manner by providing a box that is not subject to the limitations of the painter's boxes heretofore known.

Another important object is to provide a painter's box that enables its owner to design its interior in almost any configuration so that new or additional tools and materials may be stored and used as the artist's skills develop.

Another object is to advance the art of box design in general by providing a new hinge design having utility in connection with boxes of all types with removable lids.

A more specific object is to provide a painter's box design that accommodates a palette in a unique way.

Other important objects include providing a painter's box that has a reversible design so that it can be used conveniently by left-handed people as well as right-handed people.

These and many other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
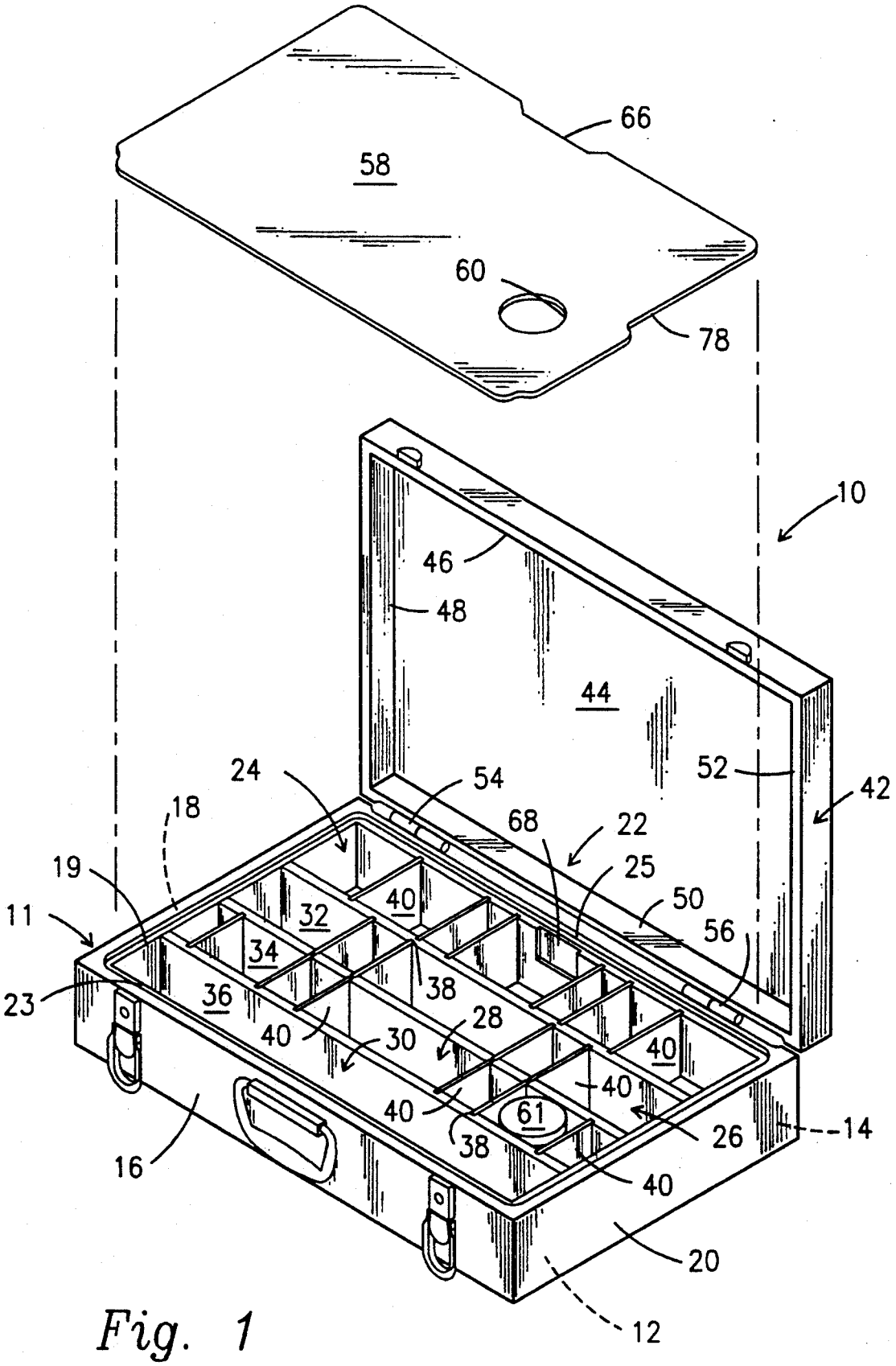
FIG. 1 is an exploded perspective view of an illustrative embodiment of the painter's box of this invention.

Referring now to FIG. 1, it will there be seen that an exemplary embodiment of the invention is denoted as a whole by the reference numeral 10.

Painter's box 10 includes main body 11 formed by an imperforate bottom wall 12, back wall 14, front wall 16, and side walls 18, 20 mounted about the periphery of said bottom wall in upstanding relation thereto. The side walls are joined to the bottom wall and to each other by conventional means.

The hollow interior of the box is generally denoted 22; it is permanently divided, in this preferred embodiment, into four primary, laterally extending subcompartments denoted 24, 26, 28, and 30 as a whole by solid wood dividers 32, 34, and 36. Each divider 32, 34, 36 has slots, collectively denoted 38, formed in its opposite sides as shown except that 36 has slots, preferably, on only one side; these slots slideably receive the opposite edges of partition members, collectively denoted 40. Thus, the painter may arrange partition walls 40 in any desired pattern to accommodate the storage of articles of differing sizes, thereby attaining an important object of this invention.

Box 10 further includes lid 42 formed by an imperforate top wall 44 and side walls 46, 48, 50, and 52 that depend from the peripheral edges thereof. A pair of hinge members 54, 56 (FIG. 3) are provided for hingedly attaching lid 42 to main body 11; these hinge members are of the pull-apart slip hinge type and enable facile separation of said lid and main body in the manner depicted in FIG. 2.

Figure 6:
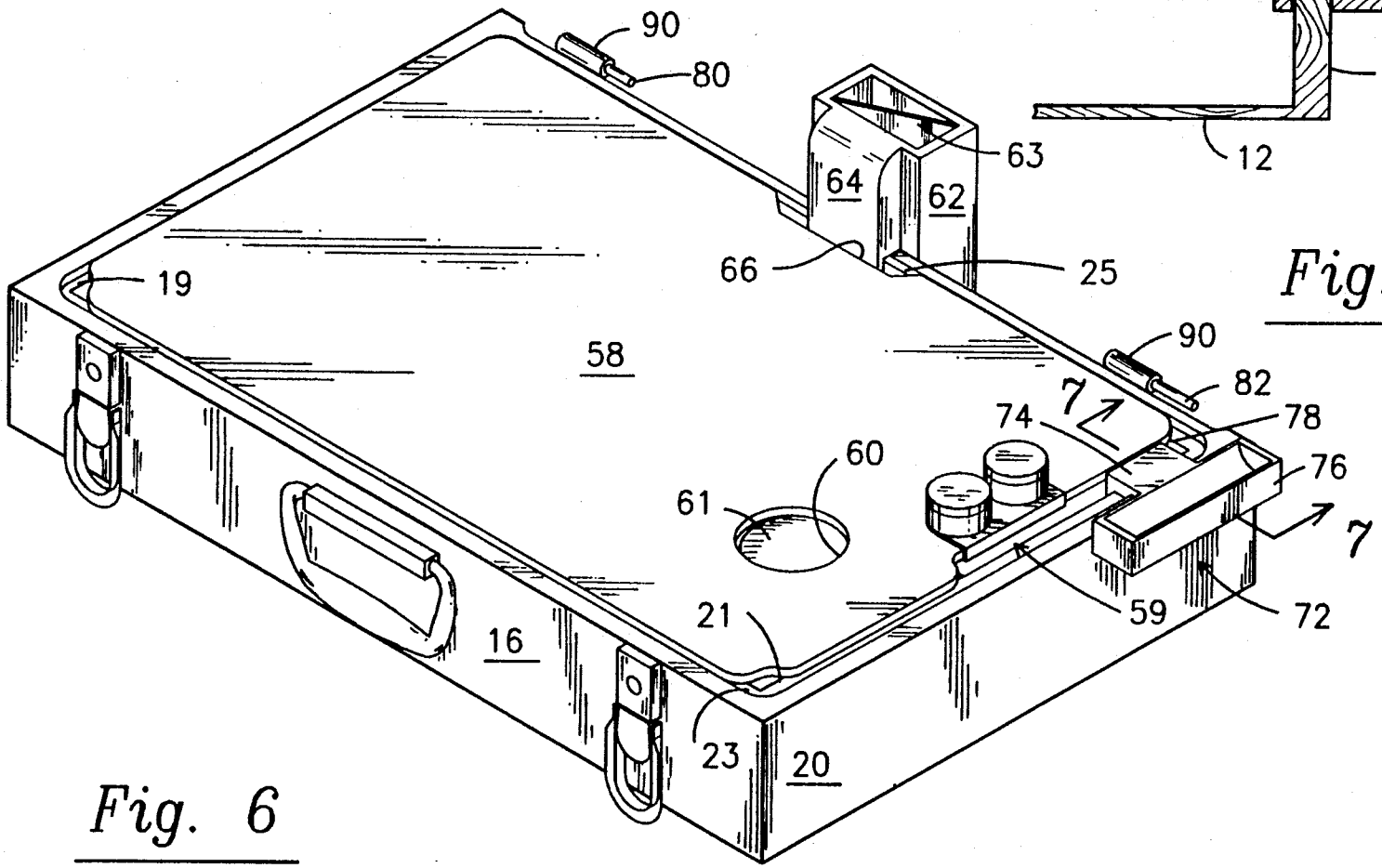
FIG. 6 is an exploded perspective view of the box with the palette, brush holder, and charcoal holder in position for use, and with the lid removed from said box.

Palette 58 has a predetermined thickness and a predetermined breadth substantially equal to but slightly less than the breadth of box 10 as perhaps best understood in connection with FIG. 6. Upstanding walls 16, and 20, of main body 11 (FIG. 1), have a recess 19, 21, 23, and 25, respectively, formed in an uppermost inner edge thereof, and each of said recesses has a depth substantially equal to the predetermined thickness of the palette. Palette 58 has a top surface that is substantially flush with the uppermost outer edges of said upstanding walls 16, 18, 20, and 22 when said palette is supported by said walls, and depending walls 46, 48, 50, and 52 of lid 42 overlie the outer peripheral edges of said palette when said lid is closed so that said palette is held securely against movement when said lid is closed and so that said palette does not interfere with the closing of said lid. It should be understood that the respective thicknesses of main body upstanding walls 14, 16, 18, and 20, and lid depending walls 46, 48, 50, and 52 are the same, and that the recesses 19, 21, 23, and 25 formed in the former that accommodate the peripheral edges of palette 58 enable the latter to overlie said peripheral edges of said palette to hold it against movement when the box 10 is being carried or otherwise transported.

Figure 2:
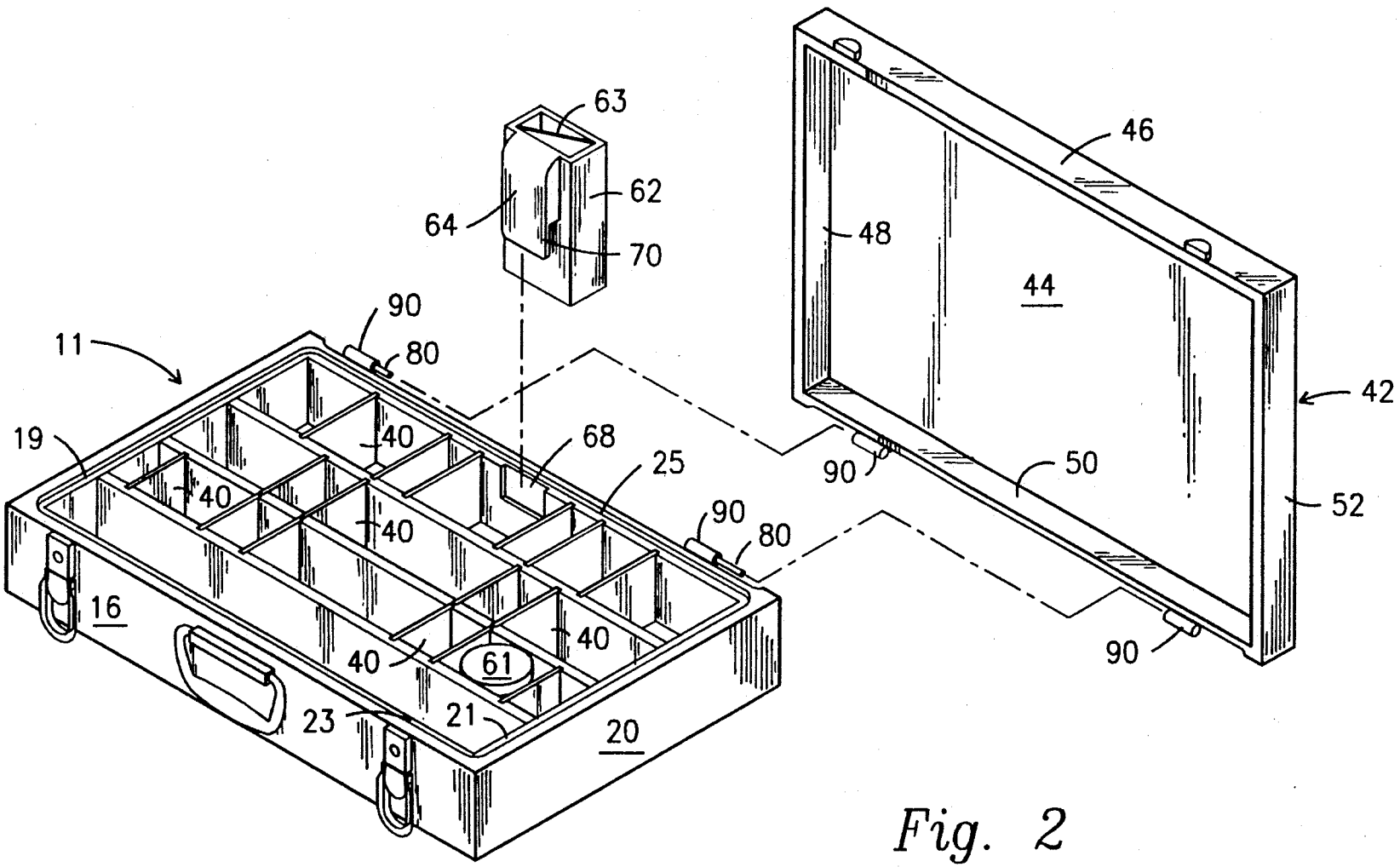
FIG. 2 is an exploded perspective view showing the lid and brush holder of the box in their respective detached configurations.

Well opening 60 is formed in said palette as shown, said well opening being disposed in juxtaposition with a jar such as a jar of mineral spirits 61 disposed within a subcompartment when said palette is disposed in closing relation to the hollow interior 22 of main body 11. The well opening also serves as a thumb-receiving hole enabling holding of the palette in the well-known way when the palette 58 is removed from said disposition. A pair of partition walls 40, 40 are disposed in flanking relation to jar 61 as shown in FIGS. 1 and 2 to prevent movement of said jar. Thus, although the other partition walls 40 are selectively positionable as desired by the artist in any preselected pattern, it is recommended that the walls immediately flanking said jar 61 be used as depicted for the reason just expressed.

A conventional medium cup 59 may be clipped to palette 58 at any preselected location along the side cut-out edge of said palette 78.

Brush box 62, shown in FIG. 2, holds brushes, not shown, and includes an attachment means that enables it to be releasably attached to any of the upstanding walls of the main body 11. Preferably, however, the brush box would not be attached to front wall 16. The attachment means is provided in the form of a handle 64 which is disposed in spaced apart, parallel relation to a brush-holding part of the brush box, said space being slightly greater than the thickness of an upstanding wall of main body 11 so that upstanding walls 14, 18, or 20 may be slideably received between said handle and said brush-holding part when said brush box is removably mounted to one of said preselected walls.

A removably mounted, diagonally disposed divider wall 63 enables the artist to separate used brushes from unused brushes. Note also that subcompartment 30 at the front of box 10 is preferably not subdivided by partition walls 40 so that the brush box and the brushes held thereby may be stored therein.

A recess 66 of predetermined depth is formed in a preselected edge of the palette, said predetermined depth being substantially equal to the thickness of handle 64 of brush box 62 so that the palette may be disposed atop said upstanding walls when the brush box is mounted to a preselected wall as depicted in FIG. 6, said recess formed in said preselected edge of said palette accommodating handle 64 of said brush box as aforesaid so that said handle does not interfere with the disposition of the palette and so that removing the palette from its disposition does not interfere with the mounting of the brush box.

A slot 68 of predetermined depth is formed in the preselected upstanding wall to which said brush box is removably mountable, said predetermined depth being substantially equal to the thickness of a lower end 70 (FIG. 2) of said brush box handle 64 so that said brush box handle does not extend into the hollow interior of the painter's box and thus does not interfere with any articles that may be positioned in a subcompartment adjacent said brush box handle. In the illustrative embodiment of FIGS. 1 and 2, the preselected upstanding wall within which slot 68 is formed is the rear wall 14. The preferred location of slot 68 is mid-length of said rear wall so that the brush box is conveniently located for both left and right-handed artists.

A charcoal holder 72 (FIG. 6) for holding charcoal also has an attachment means that enables it to be releasably attached to any of the upstanding walls of main body 11. More particularly, said attachment means is provided in the form of a handle 74, and said handle is disposed in spaced apart, parallel relation to charcoal-holding part 76 of said charcoal holder, said space being slightly greater than the thickness of side wall 18 or 20 so that such side wall may be slideably received between said handle and said charcoal-holding part when said charcoal holder is removably mounted to a preselected side wall, as depicted in FIGS. 6 and 7.

Figure 7:
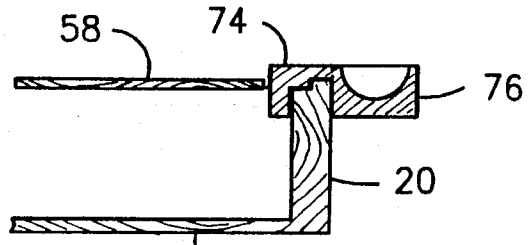
FIG. 7 is a sectional view taken along line 7—7 in FIG. 6.

Recess 78 of predetermined depth is formed in a side edge of the palette, said predetermined depth being sufficient to accommodate handle 74 of charcoal holder 72 as perhaps best shown in FIG. 7, so that palette 58 may be disposed atop upstanding walls 14, 16, 18, and 20 when said charcoal holder is mounted to said preselected side wall, said recess formed in said preselected edge of said palette accommodating the handle of said charcoal holder so that said handle does not interfere with the disposition of said palette and so that removing said palette from its disposition does not interfere with the mounting of said charcoal holder. Note that recess 78 is long enough to accommodate not only handle 74 of charcoal holder 72 but also handle 64 of brush holder 62 or palette cup 59. When the palette is reversed for left-handed use, recess 78 will be on the left and handle 74 of charcoal holder 76 is placed therein, as is handle 64 of brush holder 62 or palette cup 59 if desired. The position of mineral spirits jar 61, and its flanking partitions 40 would also be changed as required by a left-handed artist.

Hinge members 54, 56 (FIGS. 1 and 3) are of the pull-apart slip hinge type so that lid 42 is detachably securable to main body 11; they are extruded rather than rolled to provide extra strength. Means for facilitating the reattachment of lid 42 to main body 11 includes two slip hinge assemblies. More particularly, said facilitating means includes a first hinge pin 80 and a second hinge pin 80 (FIG. 2), said first hinge pin having a length less than the length of said second hinge pin so that said lid is reattached by first slideably inserting the second hinge pin into its associated slip hinge assembly, followed by slideable insertion of said first hinge pin into its associated slip hinge pin assembly, said prior insertion of said longer pin enabling facile insertion of said shorter pin. Pins 80, 82 have rounded or beveled free ends to further facilitate their insertion into their respective barrels 90, and are made of stainless steel to resist bending.

Figure 3:
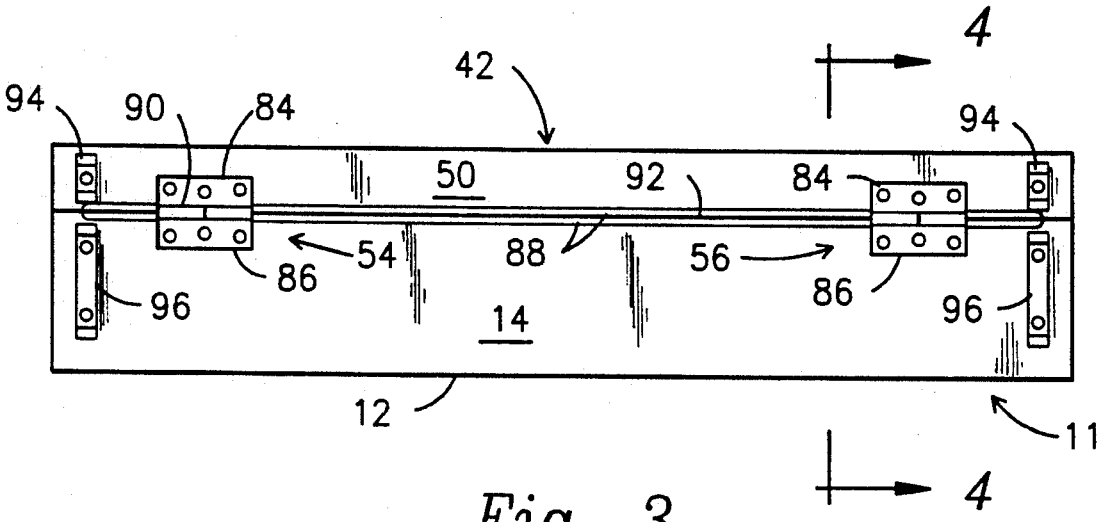
FIG. 3 is a rear elevational view of said box.
Figure 4:
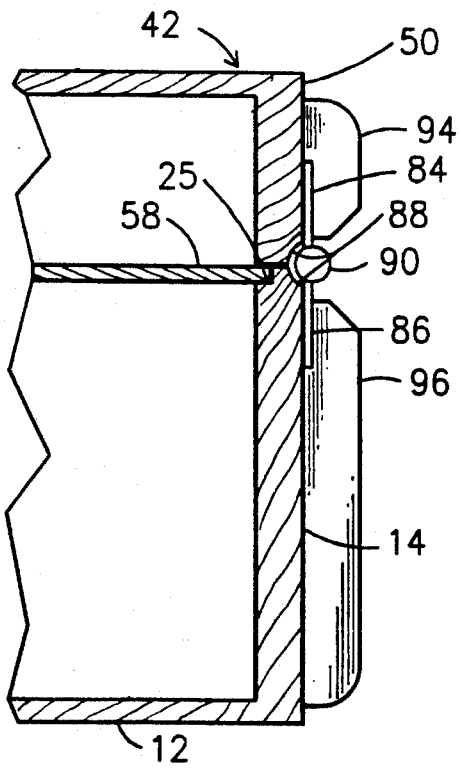
FIG. 4 is a partial side elevational view thereof.
Figure 5:
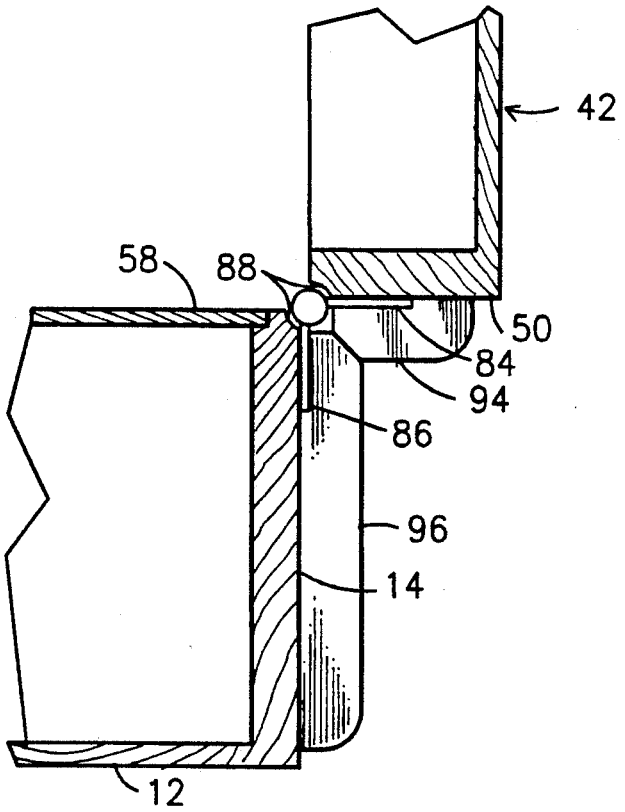
FIG. 5 is a partial side elevational view similar to the view of FIG. 4, but showing the lid in its open configuration.

As shown in FIGS. 3–5, each of the slip hinge assemblies 54, 56 includes a lid leaf 84 that is fixedly secured to lid 42 of painter's box 10 and main body leaf 86 that is fixedly secured to the main body part 11 of said painter's box. A concavity 88 for accommodating barrel 90 of each of said slip hinge assemblies facilitates alignment of said lid leaf 84 and said main body leaf 86 of said slip hinge assemblies, said concavity being longitudinally centered on parting line 92 (FIG. 3) between lid 42 and main body 11 of said painter's box.

The supporting means for reducing stress on the hinge means when said lid is disposed in a completely open position, i.e., where it is disposed normal to said main body of said painter's box, as shown in FIG. 5, includes a first pair of beveled legs, collectively denoted 94, secured to an exterior surface of the rear wall 50 of said lid in laterally spaced relation to one another and a second pair of beveled legs, collectively denoted 96, secured to an exterior surface of rear wall 14 of main body member 11 in laterally spaced apart relation to one another and in cooperative alignment with said first pair of beveled legs. The first and second pair of beveled legs support the painter's box when said box is disposed in a vertical plane with said first and second beveled legs being supported by a support surface. The beveled legs secured to the lid are disposed in abutting engagement with the beveled legs secured to the main body when the main body is disposed in a substantially horizontal plane and the lid is open, whereby the beveled legs at least in part support the weight of the lid and thus reduce the stress applied to the hinge means, and further serve to prevent over-rotation of the lid to further reduce the stress applied to the hinge means, as perhaps best understood in connection with FIG. 5.

Each of the legs 94, 96 has a forty five degree bevel formed therein as shown in FIGS. 4 and 5 so that abutment of said beveled legs of said first and second pair of beveled legs positions said lid in normal relation to said main body when the lid is fully open as depicted in FIG. 5.

Although painter's box 10 may be provided in any convenient size and any suitable material, a commercial embodiment thereof is made of wood and fits beneath airline seats; it is therefore accepted as a carry on item by all airlines.

Many important features provided by painter's box 10 were heretofore unknown; considered as a whole, these features provide a painter's box of unsurpassed utility.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A painter's box, comprising:

a main body having a hollow interior;

a lid;

a hinge means for hingedly attaching said lid to said main body;

said main body including a bottom wall, and a plurality of upstanding walls including a rear wall, a front wall, and a pair of side walls mounted about a periphery of said bottom wall in upstanding relation thereto;

a reversible palette having a predetermined thickness and a predetermined breadth slightly less than a breadth of said painter's box;

each of said upstanding walls having a recess formed in an uppermost, inner edge thereof, said recess having a depth substantially equal to the predetermined thickness of said palette;

said palette having a top surface that is substantially flush with the uppermost edges of an outer edge of said upstanding walls when said palette is supported about its outermost peripheral edges by said uppermost, inner edges of said upstanding walls;

said lid having a plurality of depending walls that overlie said upstanding walls of said main body and the peripheral edges of said palette when said lid is closed;

a well opening formed in said palette, said well opening accommodating an upper end of a jar disposed therebelow within a subcompartment when said palette is disposed in closing relation to said hollow interior of said main body, and said well opening also serving as a thumb-receiving hole enabling holding of said palette when said palette is removed from said disposition;

whereby said palette is held securely against movement when said lid is closed;

whereby said palette does not interfere with the closing of said lid; and whereby said well opening performs two functions.

2. The painter's box of claim 1, further comprising a brush box for holding brushes, said brush box having an attachment means that enables it to be releasably attached to any of said upstanding walls.

3. The painter's box of claim 2, wherein said attachment means is provided in the form of a handle, said handle being disposed in spaced apart, parallel relation to a brush-holding part of said brush box, said space being slightly greater than a thickness of a first preselected upstanding wall of said main body so that said first preselected upstanding wall of said main body may be slideably received between said handle and said brush-holding part when said brush box is removably mounted to said first preselected upstanding wall of said main body.

4. The painter's box of claim 3, further comprising a first recess of predetermined depth formed in a first preselected edge of said palette, said predetermined depth being substantially equal to a thickness of said handle of said brush box so that said palette may be disposed atop said upstanding walls of said main body when said brush box is mounted to said first preselected upstanding wall, said recess formed in said first preselected edge of said palette accommodating the handle of said brush box so that said handle does not interfere with the disposition of said palette and so that removing said palette from its disposition does not interfere with the mounting of said brush box.

5. The painter's box of claim 4, wherein said first preselected upstanding wall of said main body is said rear upstanding wall, and further comprising a slot of predetermined depth formed in said rear upstanding wall to which said brush box is removably mounted, said predetermined depth being substantially equal to said thickness of said brush box handle so that said brush box handle does not extend into the hollow interior of said painter's box and thus does not interfere with any articles that may be positioned in a subcompartment adjacent said brush box handle.

6. The painter's box of claim 1, further comprising a charcoal holder for holding charcoal, said charcoal holder having an attachment means that enables it to be releasably attached to any of said upstanding walls of said main body.

7. The painter's box of claim 6, wherein said attachment means is provided in the form of a handle, said handle being disposed in spaced apart, parallel relation to a charcoal-holding part of said charcoal holder, said space between said handle and said charcoal-holding part being slightly greater than a thickness of a second preselected upstanding wall of said main body so that said second preselected upstanding wall of said main body is slideably received between said handle and said charcoal-holding part when said charcoal holder is removably mounted to said second preselected wall of said main body.

8. The painter's box of claim 7, further comprising a second recess of predetermined depth formed in a second preselected edge of said palette, said predetermined depth of said second recess being substantially equal to a thickness of said handle of said charcoal holder so that said palette may be disposed atop said side walls of said main body when said charcoal holder is mounted to said second preselected upstanding wall, said recess formed in said second preselected edge of said palette accommodating the handle of said charcoal holder so that said handle does not interfere with the disposition of said palette and so that removing said palette from its disposition does not interfere with the mounting of said charcoal holder.

9. The painter's box of claim 1, wherein said hinge means is a pull-apart slip hinge means so that said lid is detachably secured to said main body by said slip hinge means, and wherein said slip hinge means includes facilitating means for facilitating the reattachment of said lid to said main body.

10. The painter's box of claim 9, wherein said pull-apart slip hinge means includes two slip hinge assemblies, and wherein said facilitating means includes a first hinge pin and a second hinge pin, said first hinge pin having a length greater than a length of said second hinge pin so that said lid is reattached by first slideably inserting the first hinge pin into its associated slip hinge assembly, followed by slideable insertion of said second hinge pin into its associated slip hinge pin assembly, said prior insertion of said longer pin enabling facile insertion of said shorter pin.

11. The painter's box of claim 10, wherein each of said slip hinge assemblies includes a lid leaf that is fixedly secured to the lid of said painter's box and a main body leaf that is fixedly secured to the main body part of said painter's box, and further comprising a concavity for accommodating a barrel of each of said slip hinge assemblies to facilitate alignment of the lid leaf and the main body leaf of said slip hinge assemblies, said concavity being longitudinally centered on a parting line between said lid and said main body of said painter's box and being formed in said lid and said main body.

12. The painter's box of claim 1, further comprising:

supporting means for reducing the stress on said hinge means when said lid is disposed in a completely open position where it is disposed normal to said main body of said painter's box;

said supporting means including a first pair of beveled legs secured to a rear wall of said lid in laterally spaced relation to one another and a second pair of beveled legs secured to an exterior surface of said rear wall of said main body in laterally spaced apart relation to one another and in cooperative alignment with said first pair of beveled legs;

said first and second pair of beveled legs supporting the painter's box when it is disposed in a vertical plane with said first and second beveled legs being supported by a support surface; and said beveled legs secured to said lid being disposed in abutting engagement with the beveled legs secured to said main body when said main body is disposed in a substantially horizontal plane and said lid is open;

whereby said beveled legs at least in part support the weight of said lid and thus reduce the stress applied to said hinge means, and further serve to prevent over-rotation of said lid to further reduce the stress applied to said hinge means.

13. The painter's box of claim 12, wherein each of said legs has a forty five degree bevel formed therein so that abutment of said beveled legs of said first and second pair of beveled legs positions said lid in normal relation to said main body when said lid is fully open.

14. The painter's box of claim 1, wherein said hollow interior is subdivided into a plurality of subcompartments by a plurality of permanent divider members.

15. The painter's box of claim 14, further comprising a plurality of slots formed in each of said divider members, on opposite sides thereof, and further comprising a plurality of partition wall members having opposite ends slideably disposed within said slots in a predetermined pattern.

* * * * *